US006358321B1

(12) United States Patent
Meyer et al.

(10) Patent No.: US 6,358,321 B1
(45) Date of Patent: Mar. 19, 2002

(54) CORNER PAINT SHIELD

(76) Inventors: Barbara Meyer; Helmut Richard Meyer, both of 15 North St. West, Otterville, Ontario (CA), N0J 1R0

( * ) Notice: Subject to any disclaimer, the term of this patent is extended or adjusted under 35 U.S.C. 154(b) by 0 days.

(21) Appl. No.: 09/373,491

(22) Filed: Aug. 12, 1999

Related U.S. Application Data

(60) Provisional application No. 60/096,254, filed on Aug. 12, 1998.

(51) Int. Cl.[7] ..... B05C 17/00
(52) U.S. Cl. ..... 118/504; 118/505
(58) Field of Search ..... 118/504, 505; 427/282

(56) References Cited

U.S. PATENT DOCUMENTS 2,538,743 A * 1/1951 Alston ..... 118/504
4,331,716 A * 5/1982 Stark ..... 427/282

FOREIGN PATENT DOCUMENTS

CA 2176402 10/1996

* cited by examiner

*Primary Examiner*—Laura Edwards
(74) *Attorney, Agent, or Firm*—Young & Basile, PC

(57) ABSTRACT

A corner paint shield apparatus having at least one arm including at least one groove for collecting excess paint and an outer lip for preventing paint from seeping from the painted surface to one not intended to receive paint. The shield further includes a member attached to the arm for moving the paint shield to and from a desired position.

21 Claims, 3 Drawing Sheets

CORNER PAINT SHIELD

CROSS REFERENCE TO CO-PENDING APPLICATION

This application claims the benefit of the priority date of co-pending Provisional Application Ser. No. 60/096,254, filed Aug. 12, 1998 in the names of Barbara Meyer and Helmut Meyer, the entire contents of which are incorporated herein by reference.

FIELD OF THE INVENTION

The present invention relates to a shielding apparatus, particularly shields used for painting and, more particularly, to a corner paint shield for glass pane windows, doors, baseboards, ceilings, etc.

BACKGROUND OF THE INVENTION

Apparatus for shielding liquids, particularly paints and stains from an undesired area are known in the art. Such shields have taken the form of rolled adhesive tape and handheld devices with flexible or semi-rigid blades. The tape or blade is placed over the area that is not to receive the liquid, for exemplary purposes, paint. Once the shield is placed over the area to be protected, a paintbrush or roller may apply paint to the limits of the desired area in a not-so-careful manner such that if that the brush or roller goes beyond the desired location, excess paint will be applied to the shield and not the undesired surface.

A common application of paint in a highly visible area is on wood trim moldings around doors and windows. Accuracy on the application of paint around windows is required due to the undesirability of paint on the window screen or other window treatment. Of particular difficulty is in a corner where moldings form a 90° or other angle. When using a brush to apply paint, the corner tends to bunch up the bristles and an excessive amount of paint is unintentionally squeezed from the brush thereby depositing an overabundance of paint in the area. This condition results in the excess paint flowing to undesired areas necessitating difficult removal of the excess.

Straight, single blade shields are often ineffective as a device as they only protect one molding forming one half of the corner angle. Use of two, single blade shields is awkward to hold in position and control as described in Canadian Patent No. 2,176,402 to Spence. Such single blade devices also suffered from a lack of structural stability, difficulty in handling and deficiencies in collecting and holding excess paint.

The prior art shields described above are problematic due to the use of designs and materials which lack strength, stability, adequate rigidity and are difficult to use.

Prior art designs are also problematic due to the inability or deficiency to collect and hold excess paint or liquid deep in the corner or angle between adjoining moldings. The paint shield disclosed in Spence includes grooves that do not extend into and through the corner allowing for excess paint to deposit and uncontrollably flow to undesired areas as described above.

Prior art shields are also problematic through use of continuous and relatively large bottom contact surfaces that cover the area to be protected. This is disadvantageous in several respects. A large contact surface area on the shield increases the probability the contact surface will be nonplanar and the shield will be skewed and thus will not lie flat and closely conform to the surface to be protected. Similarly, a large shield contact surface is also more prone to contact imperfections or obstructions in the surface to be protected which will force the shield away from the area to be covered. Additionally, and possibly most important, a large shield contact surface will distribute the force applied on the shield to the protective area thereby reducing the pressure from the critical area of the shield which is immediately adjacent and abuts the extreme edge of the surface to be painted.

These deficiencies permit, or increase the probability, that excess paint will pass by the shield to the area to be protected such as window glass.

Therefore, it would be desirable to provide a paint shield that improves upon or overcomes the problematic conditions in the prior art. It would also be desirable to provide a paint shield that is simple, inexpensive, easy and comfortable to use as well as being reusable an indefinite amount of times.

SUMMARY OF THE INVENTION

The present invention is a paint shield advantageously usable on a window, for example and more advantageously, in a corner of a window to protect the window glass from excess paint from a paint brush applying paint to a surrounding window trim molding.

The present invention includes at least one arm with a member attached thereto for manipulating the arm. The arm includes a top surface having at least one groove and an outer lip formed from the top surface and a bottom surface having a recess. The outer lip abuts the surface to be painted and prevents paint from seeping to the surface to be shielded from paint.

The arm of the present invention may terminate in a raised side wall at each end of the arm. The groove on a top surface of the arm extends substantially the entire length of the arm ending at the raised side walls or immediately adjacent thereto.

The outer lip may include an outer wall joining the top and bottom surfaces of the arm and may further include an outer edge formed by the outer wall and the bottom surface of the arm.

In a preferred aspect of the present invention, the paint shield includes first and second interconnected arms disposed at a 90° angle having a member extending between the first and second arms for manipulating the position of the paint shield.

BRIEF DESCRIPTION OF THE DRAWINGS

The various features, advantages and other uses of the present will become more apparent by referring to the following description of the drawings and detailed description of the invention.

The description herein makes reference to the accompanying drawings wherein like reference numerals refer to like parts throughout the several views, and wherein.

DETAILED DESCRIPTION OF THE INVENTION

As shown in FIGS. 1–4, the paint shield 10 is preferably in the form of a one piece, unitary, molded member. The paint shield 10 is preferably formed of a molded plastic; although other materials, such as wood, composites, metal, etc., may also be employed. Further, the paint shield 10 is preferably formed with a substantially rigid construction to prevent flexing in use.

Figure 1:
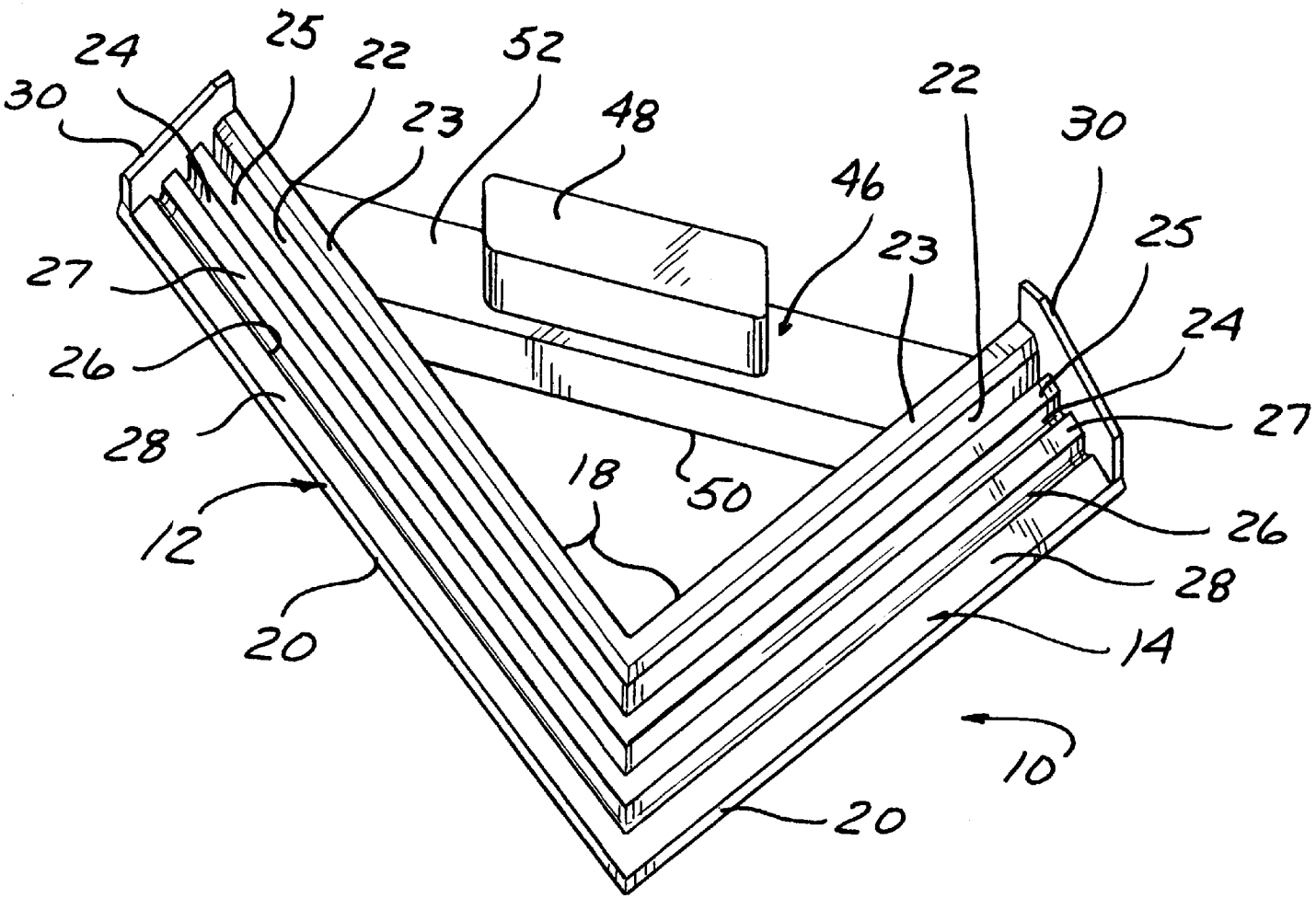
FIG. 1 is a perspective view of the window corner paint shield of the present invention.
Figure 2:
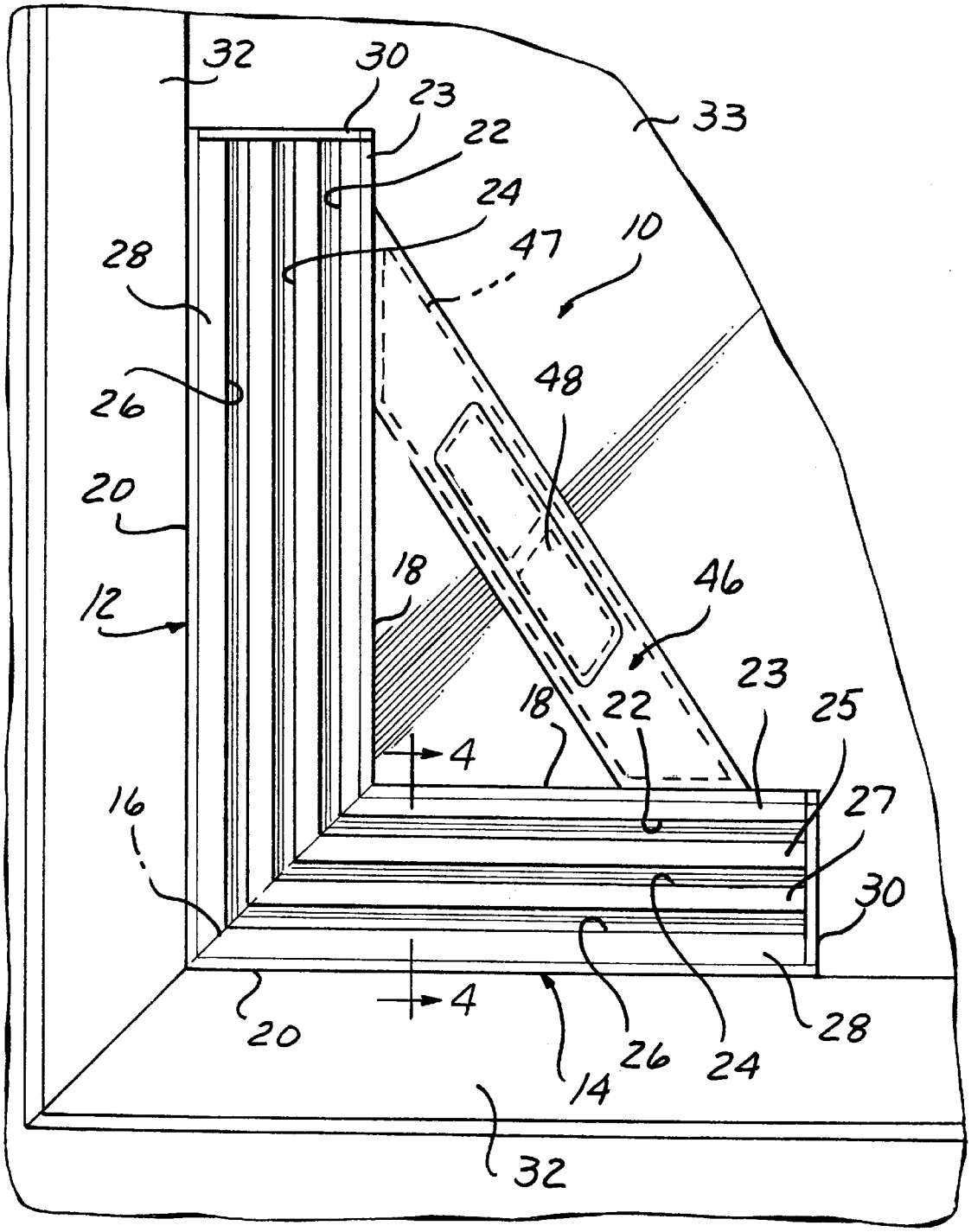
FIG. 2 is a plan view of the window corner paint shield positioned in a window corner.

As shown in FIGS. 1 and 2, by example only, the paint shield 10 includes first and second arms 12 and 14, respectively. Preferably, the arms 12 and 14 are disposed 90° apart and interconnected at a common edge or joint 16 along a 45° angle. It will be understood that the paint shield of the present invention may also take other forms including one or more arms, such as a simple straight edge with one arm, or a square or other polygonal shape with a plurality of arms.

The first arm 12 and second arm 14 are similarly constructed. Thus, the following description of the construction of the second arm 14 will be understood to apply equally to the construction of the first arm 12.

Figure 4:
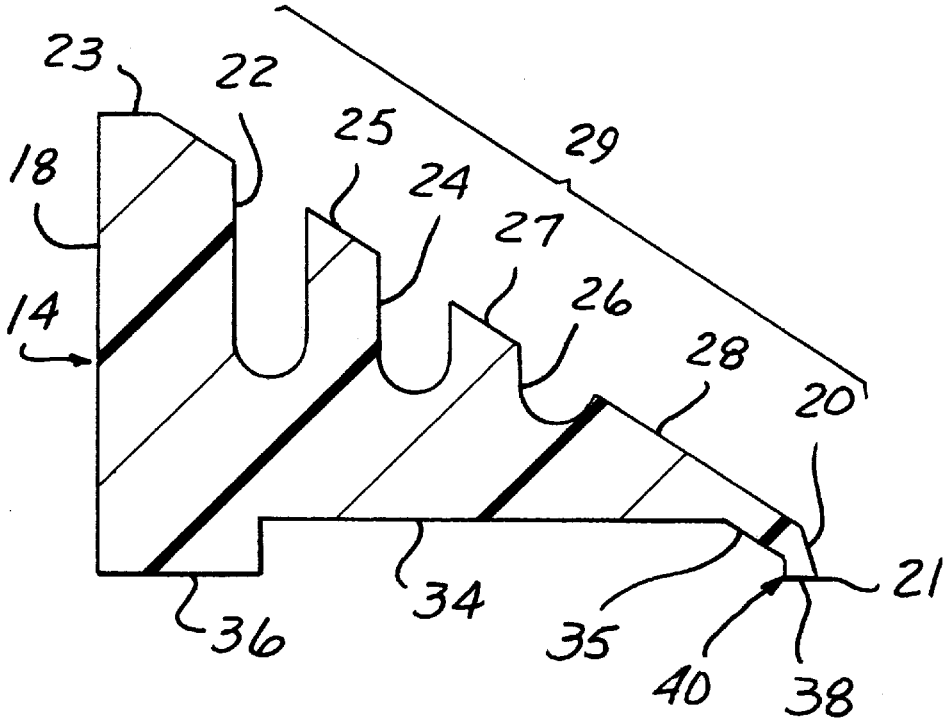
FIG. 4 is an enlarged cross sectional view generally taken along the line of 4—4 in FIG. 2.

As shown in FIG. 4, the second arm 14 has a generally wedge or triangular shape extending between a higher or longer height inner wall 18 to a short, angled outer wall 20. Outer wall 20 ends at an outer edge 21.

At least one, and preferably, a plurality of recessed grooves, with three recessed grooves 22, 24 and 26 being illustrated by way of example, are formed in the top surface 29 of the second arm 14. The recessed grooves 22, 24 and 26 may take the form of many different cross sections, such as polygonal, circular, etc. Each of the grooves 22, 24 and 26 project downwardly from the top surface 29 of the second arm 14 for a predetermined distance or depth. It is understood the number of recessed grooves, cross section configuration, and depth may vary to accommodate the particular liquid or application.

Flat top surface strips 23, 25, 27 and 28 are formed adjacent to each of the grooves 22, 24 and 26. Due to the preferred wedge or triangular shape of the arm 14, the top surface strips 25, 27 and 28 lie in a substantially common plane or along a common arc; but have a generally downwardly angled or sloped configuration from the top edge of the inner wall 18 to the top edge of outer wall 20.

As shown in FIG. 4, by example, outer wall 20 is angled or sloped with respect to top surface 29 and ends in an outer edge 21. It is understood that outer wall 20 may vary in height between the outer edge 21 and the top edge of outer wall 20 adjacent top surface strip 28 to accommodate different profiles and surfaces of trim moldings 32. Likewise, and for similar reasons, outer wall 20 may be vertical, angled or contoured to accommodate trim moldings 32.

Figure 3:
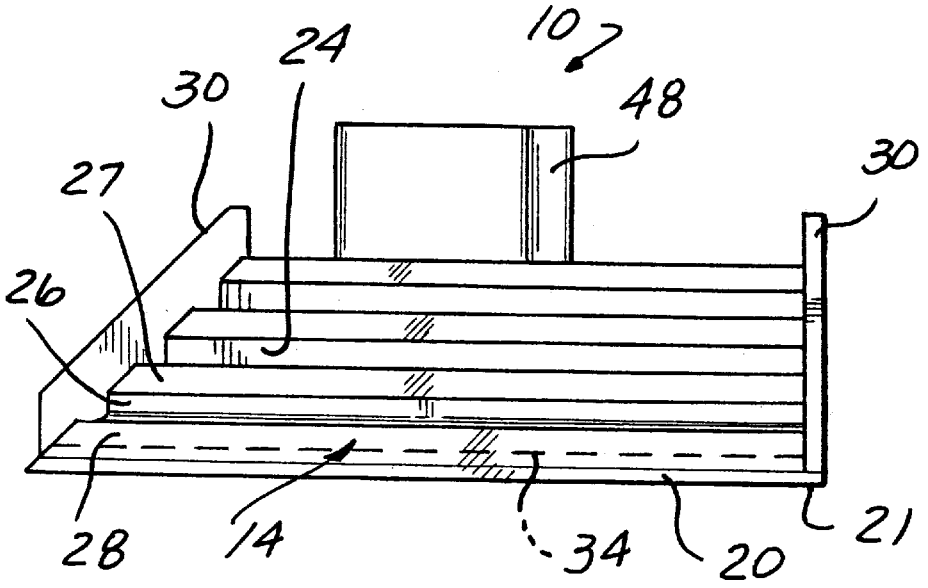
FIG. 3 is a side elevational view of the paint shield shown in FIG. 1.

As best seen in FIGS. 1 and 3, the recessed grooves 22, 24 and 26 extend substantially the entire length of second arm 14. Preferably, arm 14 includes a raised sidewall 30 which is located on and covers the end of arm 14. The grooves 22, 24 and 26 extend from side wall 30 to the edge or joint 16 between the first arm 12 and second arm 14. In this manner, the recessed grooves 22, 24 and 26 on both of the first and second arms 12 and 14, respectively, are disposed in open communication with each other at the 90° angle or joint 16. As shown in FIGS. 1 through 3, the recessed grooves 22, 24 and 26 end at another raised sidewall 30 on the first arm 12. The raised sidewalls 30 prevent excess paint from flowing from the grooves to the trim molding 32 or surrounding window 33. It is further understood that where paint shield 10 includes one arm, each end of the arm will preferably include a raised sidewall 30. In an alternate aspect of the invention, the recessed grooves end or are closed immediately adjacent the end of first arm 12 and second arm 14 obviating the primary need for raised sidewalls 30.

The recessed grooves 22, 24 and 26 function to collect excess paint from a paintbrush or roller as the paintbrush or roller is moved along the conventional trim molding 32, shown in FIG. 2, surrounding a window 33. The collected paint can be easily washed out or otherwise removed from the grooves 22, 24 and 26 for reuse of the paint shield 10. At the same time, the top surface strips 23, 25, 27 and 28 in conjunction with the recessed grooves 22, 24 and 26, form a solid, continuous surface overlaying the glass window 33 which prevents any paint from the paintbrush or roller from contacting the glass.

Although disclosed and shown for use in a window or window corner, it is understood that paint shield 10 is equally functionable for shielding paint or other materials from doors, ceilings, floors, baseboards, walls, trim moldings and the like.

As shown in FIG. 4, a recess 34 is formed in the bottom surface of the first arm 12 and second arm 14 and extends substantially along the entire length of the first arm 12 and second arm 14. The recess 34 extends laterally across the width of each of the first and second arms 12 and 14 respectively. The recess 34 forms a lip 40 which includes the outer wall 20, outer edge 21 and an outer bottom surface 38. Preferably outer edge 21 lies in the same plane as outer bottom surface 38. Recess 34, by example, is generally rectangular in shape and includes an angled portion 35 which is adjacent the outer bottom surface 38 of lip 40. Angled portion 35 is generally parallel to the top surface strip 28 to maintain adequate material thickness for strength and rigidity. It is understood that both recess 34 and angled portion 35 may be of any size and shape to accommodate the environment or application of paint shield 10 or to improve the function and ease of use of paint shield 10.

The configuration of lip 40 prevents, or reduces the possibility of, paint seeping past outer wall 20, outer edge 21 and under the outer bottom surface 38 to the glass 33. Outer bottom surface 38 is relatively narrow in a lateral direction and extends the entire length of first arm 12 and second arm 14. This relatively small contact surface area or footprint effectively concentrates the weight of paint shield 10 and/or the force applied by the user on the shield to the glass window 33 thereby further reducing the possibility of paint passing by outer edge 21 and outer bottom surface 38.

Recess 34 also forms an inner bottom surface 36. Inner bottom surface 36 and outer bottom surface 38 are substantially in the same plane although it is understood the surfaces may be in different planes to accommodate a step or contour in the window 33 or molding 32 which shield 10 rests on and/or abuts.

As shown in FIGS. 1 and 2, in a preferred aspect, a manipulating means or member 46 extends between the first arm 12 and second arm 14. By example, the member 46 preferably has a general hollow configuration with a recess 47 extending upward from a bottom surface 50 contiguous with the inner bottom surface 36. In this aspect, the member 46 bottom surface 50 lies in the same plane as the arm inner bottom surface 36 and arm outer bottom surface 38 permitting the paint shield 10 and accompanying member 46 to lie flat or flush against the window 33. In an alternative aspect, the member bottom surface 50 may lie in a different plane from the arm bottom surfaces 36 and 38 to allow clearance, or interference as desired, of the member 46 with the window 33 or other details or obstructions.

Preferably, member 46 is integrally molded to first arm 12 and second arm 14. However, it is understood member 46 may be attached using conventional attachments such as mechanical fasteners or adhesive. In an alternative aspect, where the paint shield 10 includes only one arm, the member 46 is attached to the arm in a similar manner as described above.

In a preferred aspect, projection or handle 48 is attached on an upper surface 52 of member 46 to facilitate handling and movement of the paint shield 10. Preferably, handle 48 is integrally molded with member 46 and is generally hollow and rectangular in form extending unitarily upward from a top surface 52 of the member 46. Although handle 48 is shown as a generally rectangular-shaped projection, handle 48 may take any shape or form suitable for easily manipulating or moving the shield 10 such as a knob, a post, or if member 46 is positioned away from glass 33, a through hole. Member 46 may itself be configured to act as a handle without a separate handle 48 formation.

Referring to FIG. 2, in preferable operation, the paint shield 10 is positioned using member 46 and handle 48 in a window 33 surrounded by a conventional trim molding or frame 32. The paint shield 10 is placed against the window glass pane 33 and is slid along the glass toward the desired position along the trim molding 32. As shown in FIG. 2, the preferred paint shield 10 includes two arms positioned 90° apart for use in a 90° corner.

The paint shield 10 is forced into the 90° corner of trim molding 32 such that outer wall 20 or, depending on the shape of the molding 32, outer edge 21 is in abutting engagement with the outer surface of trim molding 32 (not shown). Pressure is maintained to position the paint shield 10 against the outer edge of trim molding 32 such that, as appropriate, outer wall 20 or outer edge 21 abuttingly engages the outer wall of trim molding 32. Simultaneously, outer bottom surface 38 and inner bottom surface 36 abuttingly engages the glass pane of window 33.

The operator then applies the paint to the desired location on trim molding 32. In the event paint is applied beyond the outer edge of trim molding 32, excess paint is collected and stored in recessed grooves 22, 24 and 26 preventing excess paint from flowing onto window 33. Recessed grooves 22, 24 and 26 are continuous and therefore collect and store paint along the entire length of first and second arms 12 and 14 respectively.

As outer wall 20, or outer edge 21, abuttingly engages the outer surface of trim molding 32, a minimal amount of paint, if any, will flow down outer wall 20 to outer edge 21. Preferably, outer edge 21, lies in the same plane as outer bottom surface 38 and thereby abuttingly engages the window 33 glass pane, preventing paint from passing to outer bottom surface 38. Outer bottom surface 38 abuttingly engages window 33 preventing paint from seeping under outer bottom surface 38 onto additional portions of window 33.

Upon completion of painting the corner of trim molding 32, paint shield 10 is removed from window 33 and molding 32 through use of member 46 and handle 48. Any excess paint that has been applied to the arm top surface 29 and collected in recessed grooves 22, 24 and 26, are easily removed through use of an appropriate cleaner for that paint or other liquid. The shield 10 is then ready for reuse.

What is claimed is:

1. A paint shield comprising:

at least one arm having a length and opposing ends, said arm having:

a top surface having at least one groove for collecting a liquid;

a bottom surface having a recess;

a lip, said lip formed from said top surface, said bottom surface and said recess; and a member attached to said arm for manipulating the arm.

2. The paint shield of claim 1, wherein said groove is continuous and extends substantially the entire length of said arm.

3. The paint shield of claim 1, wherein said lip includes an outer edge along said bottom surface of said arm.

4. The paint shield of claim 1, wherein said lip includes an outer wall joining said top surface and said bottom surface, said outer wall including an outer edge formed by said outer wall and said bottom surface.

5. A paint shield comprising:

at least one arm having a length and opposing ends, said arm having:

a top surface having at least one groove;

a bottom surface having a recess;

a lip, said lip formed from said top surface, said bottom surface and said recess;

a raised sidewall at said opposing ends of said arm; and a member attached to said arm for manipulating the arm.

6. The paint shield of claim 1, wherein said member is integral with said arm.

7. A paint shield comprising:

a first arm and a second arm interconnected at a common joint and angularly disposed from one another, said first and second arms having:

a top surface having at least one groove;

a bottom surface having a recess;

a lip, said lip formed from said top surface, said bottom surface and said recess; and a member attached to said first and second arms for manipulating said arms.

8. The paint shield of claim 7, wherein said groove is continuous and extends substantially the entire length of said first arm and said second arm.

9. The paint shield of claim 7, wherein said first arm and said second arm include a raised sidewall at said opposing ends opposite said joint.

10. The paint shield of claim 7, wherein said lip includes an outer wall joining said top surface and said bottom surface, said outer wall including an outer edge formed by said outer wall and said bottom surface.

11. A paint shield comprising:

at least one arm having a length and opposing ends, said arm having;

a top surface having at least one groove;

a bottom surface having a recess;

a lip, said lip having an outer wall joining said top and said bottom surface, said lip further having an outer edge formed by said bottom surface and said outer wall;

an inner wall, said inner wall joining said top surface and said bottom surface and is opposite said outer wall; and a means for manipulating said paint shield.

12. The paint shield of claim 11, wherein said groove is continuous and extends substantially the entire of said length of said arm.

13. The paint shield of claim 11, wherein said arm includes a raised sidewall at said opposite ends of said arm.

14. The paint shield of claim 11, wherein the inner wall is of greater height than said outer wall, and wherein, said top surface is angled from said inner wall to said outer wall.

15. The paint shield of claim 11, wherein said recess forms an inner bottom surface adjacent said inner wall and said recess forms an outer bottom surface adjacent said outer edge.

16. The paint shield of claim 11, wherein said means for manipulating include a member attached to said arm.

17. The paint shield of claim 16, wherein the means for manipulating includes a handle attached to said member.

18. A paint shield having at least one arm having a length and opposite ends, said arm having a top surface including at least one groove, a bottom surface, an outer edge and a handle, the improvement comprising:

said bottom surface having a recess, and a lip, said lip formed by said recess and said top surface, said lip having an outer wall between said top surface and said outer edge, said lip having an outer bottom surface between said outer edge and said recess.

19. The improvement of claim 18, wherein said groove is continuous and extends substantially the entire of said length of said arm.

20. The improvement of claim 18, wherein said arm includes a raised sidewall at said opposite ends.

21. A paint shield comprising:

a first arm and a second arm interconnected at a common joint and angularly disposed from one another, said arms having:

a top surface having at least one groove for collecting a liquid;

a bottom surface;

a lip, said lip formed from said top surface and said bottom surface; and a member attached to said arm for manipulating the arm.

* * * * *